US012673844B2

(12) United States Patent
Runkle et al.

(10) Patent No.: US 12,673,844 B2
(45) Date of Patent: Jul. 7, 2026

(54) WELDING WIRE SPOOL WITH BREAKAWAY TAB

(71) Applicant: Hobart Brothers LLC, Troy, OH (US)

(72) Inventors: Caleb Runkle, Troy, OH (US); Brennan Mai, Troy, OH (US)

(73) Assignee: HOBART BROTHERS LLC, Troy, OH (US)

( * ) Notice: Subject to any disclaimer, the term of this patent is extended or adjusted under 35 U.S.C. 154(b) by 510 days.

(21) Appl. No.: 17/989,288

(22) Filed: Nov. 17, 2022

(65) Prior Publication Data

US 2023/0166941 A1 Jun. 1, 2023

Related U.S. Application Data

(60) Provisional application No. 63/283,852, filed on Nov. 29, 2021.

(51) Int. Cl.
*B65H 75/28* (2006.01)
*B65H 75/14* (2006.01)

(52) U.S. Cl.
CPC ..... *B65H 75/28* (2013.01); *B65H 75/14* (2013.01); *B65H 2701/36* (2013.01)

(58) Field of Classification Search
CPC ..... B65H 75/28; B65H 75/285; B65H 75/14; B65H 2701/36
See application file for complete search history.

(56) References Cited

U.S. PATENT DOCUMENTS

| | | | | |
|---|---|---|---|---|
| 1,842,143 | A * | 1/1932 | Bowen | B65H 75/14 242/118.8 |
| 3,836,059 | A | 9/1974 | Lauen | |
| 6,070,823 | A * | 6/2000 | Clary | B25B 25/00 242/388.4 |
| 7,954,748 | B2 * | 6/2011 | Weissbrod | B65H 75/14 242/580 |
| 2003/0094535 | A1 | 5/2003 | Schmidt | |
| 2009/0072074 | A1 * | 3/2009 | Tsai | B65H 75/14 242/602 |
| 2010/0155550 | A1 * | 6/2010 | Weiss-Vons | F16B 47/00 248/363 |

FOREIGN PATENT DOCUMENTS

| | | |
|---|---|---|
| DE | 875573 | 5/1953 |
| GB | 785476 | 10/1957 |
| JP | 40426977 | 3/1992 |
| JP | 11286374 | 3/1998 |
| WO | 2009118116 | 10/2009 |

* cited by examiner

*Primary Examiner* — Victoria P Augustine
*Assistant Examiner* — Nathaniel L Adams
(74) *Attorney, Agent, or Firm* — McAndrews Held & Malloy, Ltd.

(57) ABSTRACT

The present disclosure is generally directed to a welding wire spool and a method for welding wire loading and feeding. The welding wire spool comprises a drum, a first and second flange, and a tab. The tab may be frangibly attached to the first flange at an attachment area located along the perimeter of the first flange. The drum may include a drum opening. The method may include loading a spool onto a spooler, using the spooler to load wire onto the spool, hooking a length of wire through the tab opening, and unloading the spool from the spooler.

17 Claims, 2 Drawing Sheets

WELDING WIRE SPOOL WITH BREAKAWAY TAB

CROSS-REFERENCE TO RELATED APPLICATION

This application claims benefit of priority from U.S. Provisional Patent Application No. 63/283,852, filed Nov. 29, 2021, which is hereby incorporated by reference in its entirety herein.

FIELD

The present disclosure relates generally to a welding wire spool with a breakaway tab and a method for utilizing the welding wire spool with automated welding wire loading and feeding processes.

BACKGROUND

Implementation of automated processes in a welding workflow has a number of advantages. In particular, automation has the potential to improve the efficiency of various processes, including welding wire loading and feeding. Despite the advantages of automation, integration of standard welding wire spools with automated processes presents a number of challenges.

In particular, automated processes impose certain requirements on the weight of the spool. For example, the total weight of the spool that is loaded with wire must be above a certain minimum threshold in order to integrate with an automated wire feeder. Further, automated wire feeders are designed to work with standard spool dimensions that are defined by the American Welding Society ("AWS"). The requirements of using standard dimensioned spools coupled with the weight thresholds presents a challenge for implementation of automated processes with a broad range of wire types.

With many types of commonly used wires, industry standard dimensioned spools need to be filled with an amount of wire that extends to the edges of the spools' flanges in order to meet these weight thresholds. This is particularly true when utilizing lighter density (flux core) wires. The wire loaded onto the spool needs to be tied off at an opening located on the flange of an industry standard spool. When spools are filled with an amount of wire that extends to the edges of the spool's flanges, this opening is covered up by the wire. As a result, the automated wire hooking device may be unable to access the openings on the flange that are needed to tie off the wire.

There exists a need for an improved welding wire spool capable of integration with automated processes with a broad range of welding wire types and weights.

SUMMARY

The present disclosure relates generally to a welding wire spool comprising a breakaway tab and a method for welding wire loading and feeding.

According to an aspect of the present disclosure, a welding wire spool comprises: a drum having an outer drum perimeter and extending between a first flange and a second flange, wherein each flange has an outer perimeter; and a tab that is located along the perimeter of the first flange; wherein the outer perimeter of each of the first and second flanges is greater than the outer drum perimeter; wherein the first flange has a flange thickness and comprises a flange opening that extends through the flange thickness; and wherein the tab has a tab thickness and comprises a tab opening that extends through the tab thickness.

According to another aspect of the present disclosure, a method for welding wire loading and feeding comprises: loading a spool onto a spooler, wherein the spool comprises a drum having an outer drum perimeter and extending between a first flange and a second flange, wherein each flange has an outer perimeter; and a tab that is located along the perimeter of the first flange; wherein the outer perimeter of each of the first and second flanges is greater than the outer drum perimeter; wherein the first flange has a flange thickness and comprises a flange opening that extends through the flange thickness; and wherein the tab has a tab thickness and comprises a tab opening that extends through the tab thickness; using the spooler to load wire onto the spool; hooking a length of wire through the tab opening; and unloading the spool from the spooler.

It is to be understood that both the foregoing general description and the following detailed description describe various embodiments and are intended to provide an overview or framework for understanding the nature and character of the claimed subject matter. The accompanying drawings are included to provide a further understanding of the various embodiments, and are incorporated into and constitute a part of this specification. The drawings illustrate the various embodiments described herein, and together with the description serve to explain the principles and operations of the claimed subject matter.

BRIEF DESCRIPTION OF THE DRAWINGS

The following is a description of the examples depicted in the accompanying drawings. The figures are not necessarily to scale, and certain features and certain views of the figures may be exaggerated in scale or in schematic for clarity or conciseness.

Figure 1:
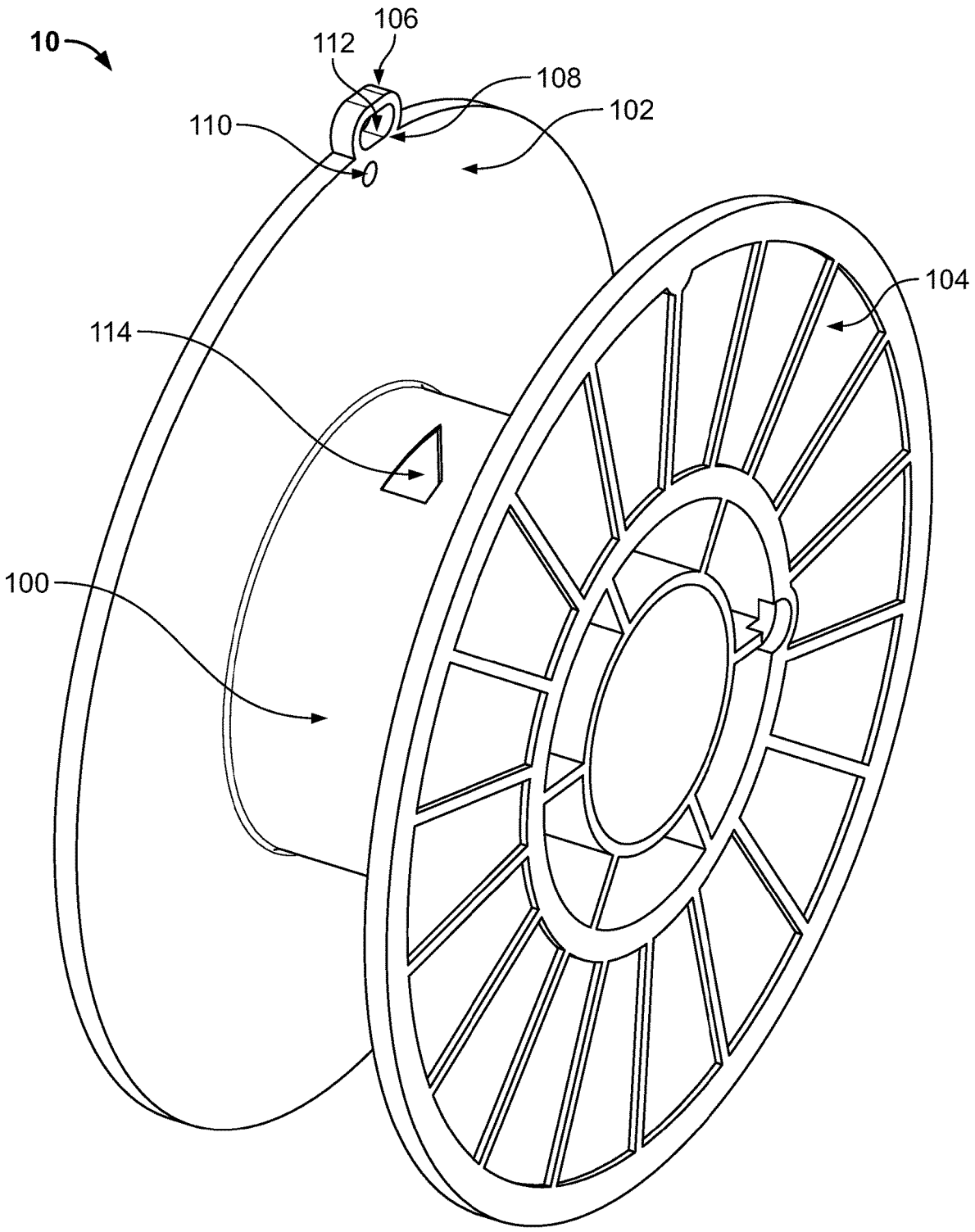
FIG. 1 shows a perspective view of a welding wire spool according to an embodiment of the present disclosure.

The foregoing summary, as well as the following detailed description, will be better understood when read in conjunction with the figures. It should be understood that the claims are not limited to the arrangements and instrumentality shown in the figures. Furthermore, the appearance shown in the figures is one of many ornamental appearances that can be employed to achieve the stated functions of the apparatus.

DETAILED DESCRIPTION

In the following detailed description, specific details may be set forth to provide a thorough understanding of the embodiments of the present disclosure. However, it will be clear to one skilled in the art when disclosed examples may be practiced without some or all of these specific details. For the sake of brevity, well-known features or processes may not be described in detail. In addition, like or identical reference numerals may be used to identify common or similar elements.

One or more specific embodiments of the present disclosure will be described below. In an effort to provide a concise description of these embodiments, all features with an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," "the," and "said" are intended to mean that there are one or more of the elements. The terms "comprising," "including," and "having" are intended to be inclusive and mean that there may be additional elements other than the listed elements.

As illustrated in FIG. 1, a welding wire spool 10 may comprise a drum 100 comprising an outer drum perimeter that extends between a first flange 102 and a second flange 104. The drum 100 may comprise a drum opening 114 that extends through the thickness of the drum perimeter. Each flange 102, 104 has an outer perimeter. The outer perimeter of the first and second flanges 102, 104 is greater than the outer drum perimeter of the drum 100. Each flange may have a flange opening that extends through the thickness of the flange. For example, the first flange 102 may comprise a flange opening 110 that extends through the thickness of the first flange 102. A tab 106 may be located along the outer perimeter of one or both of the flanges. For example, a tab 106 may be located along the outer perimeter of the first flange 102 at an attachment area 108. The tab 106 may comprise a tab opening 112 that extends through the thickness of the tab 106. A wire may be loaded onto the welding wire spool 10 and a length of wire may be passed through one or more of the openings (e.g., a length of wire may be passed through the tab opening 112 and "hooked" by bending a length of the wire so as to secure its position and limit unravelling of the wire from around the spool).

Figure 2:
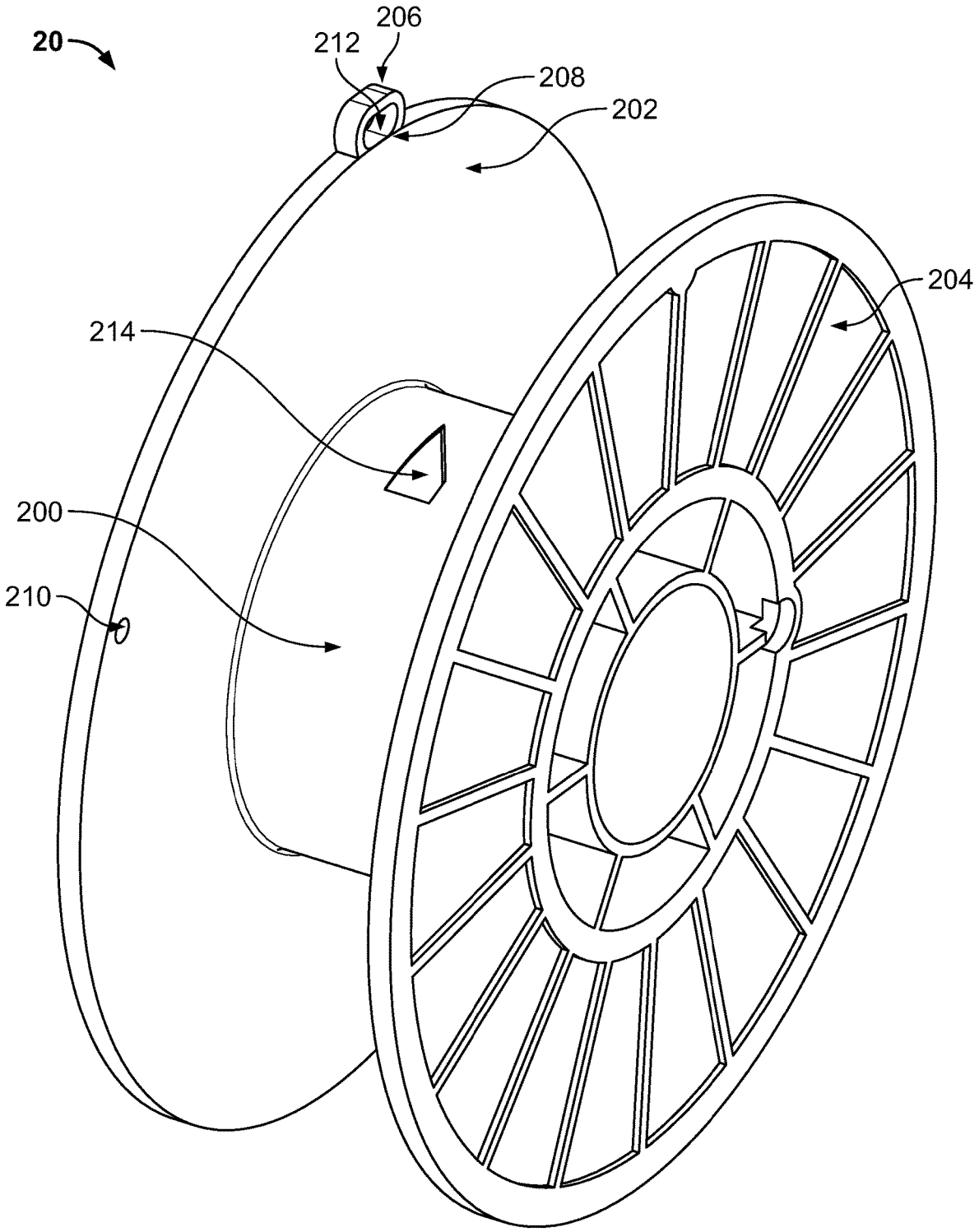
FIG. 2 shows a perspective view of a welding wire spool according to another embodiment of the present disclosure.

Similarly, as illustrated in FIG. 2, a welding wire spool 20 may comprise a drum 200 comprising an outer drum perimeter that extends between a first flange 202 and a second flange 204. The drum 200 may comprise a drum opening 214 that extends through the thickness of the drum perimeter. Each flange 202, 204 has an outer perimeter. The outer perimeter of the first and second flanges 202, 204 is greater than the outer drum perimeter of the drum 200. Each flange may have a flange opening that extends through the thickness of the flange. For example, the first flange 202 may comprise a flange opening 210 that extends through the thickness of the first flange 202. A tab 206 may be located along the outer perimeter of one or both of the flanges. For example, a tab 206 may be located along the outer perimeter of the first flange 202 at an attachment area, which may comprise a relief line 208. The tab 206 may comprise a tab opening 212 that extends through the thickness of the tab 206. A wire may be loaded onto the welding wire spool 20 and a length of wire may be passed through one or more of the openings (e.g., a length of wire may be passed through the tab opening 212 and "hooked" by bending a length of the wire so as to secure its position and limit unravelling of the wire from around the spool).

It may be advantageous to vary the relative locations of the tab, the flange opening, and the drum opening. For example, as illustrated in FIG. 1, flange opening 110 may be located on first flange 102 directly below tab opening 112. Further, as illustrated in FIG. 1, drum opening 114 may be located along a radial axis that bisects flange opening 110. Aligning one or more of the openings (e.g., aligning the tab opening 112 and the drum opening 114) may provide advantages for automated systems so that a wire can be fed through one or more of the openings in an appropriate position. In another embodiment, as illustrated in FIG. 2, flange opening 210 may be located in a position along first flange 202 that is not along a radial axis that bisects the drum opening 214. In other aspects of the present disclosure, relative locations of the tab, flange opening, and drum opening may be varied along the flange and drum.

The tab opening 112, 212 may be elliptical. In other embodiments of the present disclosure, the tab opening may comprise other shapes and sizes. For example, the tab opening may be circular, rectangular, trapezoidal, or semicircular. The shape and size of the tab may be varied depending on the type and size of the attachment area that is employed.

It may also be advantageous to vary the shape or size of the flange opening. The flange opening 110, 210 may be circular and have a diameter that is smaller than the width of the tab opening 112, 212. In other embodiments of the present disclosure, the shape or size of the flange opening may be changed. Various factors—such as the size, shape, and weight of the wire that will be loaded onto the spool—may dictate what size flange opening is desirable. For example, the flange opening may be elliptical, rectangular, trapezoidal, or semicircular.

It may also be advantageous to vary the shape or size of the drum opening. The drum opening 114, 214 may be trapezoidal. In other embodiments of the present disclosure, the shape or size of the drum opening may be changed. Various factors—such as the size, shape, and weight of the wire that will be loaded onto the spool—may dictate what size drum opening is desirable. For example, the drum opening may be circular, elliptical, rectangular, or semicircular.

In certain embodiments, the shape or size of the drum and the flanges can be varied. For example, it may be advantageous to adjust the diameter and thickness of both the drum and flanges depending on the type, thickness, and weight of the wire that is intended to be loaded onto the spool. It may also be advantageous to adjust the sizes of the drum and flanges depending on the intended tools that the spool will be implemented with. For example, different drum and flange sizes may be desirable depending on the type of spooler and the type of wire feeder that will be employed with the spool.

The welding wire spool may be made of any suitable material depending on the desired use of the spool. For example, the spool may be manufactured from plastics, steel, or fiberboard. In certain embodiments, the tab may be made from the same material as the other components of the welding wire spool. In other embodiments, the tab may be made of a different material as the other components of the welding wire spool.

In certain embodiments, the tab may be frangibly attached to one or both of the flanges. Depending on the desired application, various methodologies may be employed for the frangible attachment of the tab. For example, as illustrated in FIG. 2, the tab 206 may be frangibly attached to the first flange 202 through an attachment area that comprises a relief line 208. The relief line may comprise an area cutout from the flange. Such a design allows the tab to be attached in a manner that is secure, but still removable when needed. The relief line may vary in thickness depending on the thickness of the flange and the shape and size of the tab. In another embodiment of the present disclosure, the attachment area may comprise perforations. The choice of methodology for attaching the frangible tab may depend on various factors, such as the material the spool is made of (e.g., plastic, steel, or fiberboard), the timing of when the tab needs to be broken away, the methodology by which the tab will be broken away (e.g., manual versus automated), and the desired strength of the frangible attachment.

According to another embodiment of the present disclosure, a method for welding wire loading and feeding may comprise loading a spool into a spooler, using the spooler to load wire onto the spool, hooking a length of wire through the tab opening, and unloading the spool from the spooler. The spool employed in this method may comprise the elements described in the various embodiments above, and illustrated in FIGS. 1 and 2. According to one embodiment, the method may further comprise breaking the tab that is frangibly attached to one or both of the flanges away from the spool after unloading the spool from the spooler.

According to another embodiment of the present disclosure, a method for welding wire loading and feeding may comprise loading a spool into a spooler, using the spooler to load wire onto the spool, hooking a length of wire through the tab opening, and unloading the spool from the spooler. The spool employed in this method may comprise the elements described in the various embodiments above, and illustrated in FIGS. 1 and 2. According to one embodiment, the method may further comprise loading the spool into a wire feeder after unloading the spool from the spooler. According to another embodiment, the method may further comprise breaking the tab that is frangibly attached to one or both of the flanges away from the spool after loading the spool into the wire feeder.

The various aspects and embodiments disclosed herein are not intended to be limiting. Other embodiments may be utilized, and other changes may be made, without departing from the spirit or scope of the subject matter presented herein. It will be readily understood that the aspects of the present disclosure, as generally described herein and illustrated in the figures, can be arranged, substituted, combined, separated, and designed in a wide variety of different configurations, all of which are contemplated herein.

The invention claimed is:

1. A welding wire spool comprising:

a drum having an outer drum perimeter and extending between a first flange and a second flange, wherein each flange has an outer perimeter; and a tab that is located along and extends beyond the outer perimeter of the first flange;

wherein the outer perimeter of each of the first and second flanges is greater than the outer drum perimeter;

wherein the first flange has a flange thickness and comprises a flange opening that extends through the flange thickness;

wherein the tab has a tab thickness and comprises a tab opening that extends through the tab thickness; and wherein the tab opening is elliptical.

2. A welding wire spool comprising:

a drum having an outer drum perimeter and extending between a first flange and a second flange, wherein each flange has an outer perimeter; and a tab that is located along and extends beyond the outer perimeter of the first flange;

wherein the outer perimeter of each of the first and second flanges is greater than the outer drum perimeter;

wherein the first flange has a flange thickness and comprises a flange opening that extends through the flange thickness;

wherein the tab has a tab thickness and comprises a tab opening that extends through the tab thickness; and wherein the tab is frangibly attached to the first flange at an attachment area located along the perimeter of the first flange.

3. The welding wire spool of claim 2, wherein the drum comprises a drum perimeter thickness and a drum opening that extends through the drum perimeter thickness.

4. The welding wire spool of claim 3, wherein the drum opening is located along a radial axis that bisects the flange opening.

5. The welding wire spool of claim 2, wherein the flange opening is located along a radial axis that bisects the tab opening.

6. The welding wire spool of claim 2, wherein the attachment area comprises a relief line.

7. The welding wire spool of claim 6, wherein the attachment area comprises perforations.

8. A method for welding wire loading and feeding comprising:

loading a spool onto a spooler, wherein the spool comprises a drum having an outer drum perimeter and extending between a first flange and a second flange, wherein each flange has an outer perimeter; and a tab that is located along and extends beyond the outer perimeter of the first flange;

wherein the outer perimeter of each of the first and second flanges is greater than the outer drum perimeter;

wherein the first flange has a flange thickness and comprises a flange opening that extends through the flange thickness; and wherein the tab has a tab thickness and comprises a tab opening that extends through the tab thickness;

wherein the tab opening is elliptical;

using the spooler to load wire onto the spool;

hooking a length of wire through the tab opening; and unloading the spool from the spooler.

9. A method for welding wire loading and feeding comprising:

loading a spool onto a spooler, wherein the spool comprises a drum having an outer drum perimeter and extending between a first flange and a second flange, wherein each flange has an outer perimeter; and a tab that is located along and extends beyond the outer perimeter of the first flange;

wherein the outer perimeter of each of the first and second flanges is greater than the outer drum perimeter;

wherein the first flange has a flange thickness and comprises a flange opening that extends through the flange thickness; and wherein the tab has a tab thickness and comprises a tab opening that extends through the tab thickness;

wherein the tab is frangibly attached to the first flange at an attachment area located along the perimeter of the first flange;

using the spooler to load wire onto the spool;

hooking a length of wire through the tab opening; and unloading the spool from the spooler.

10. The method for welding wire loading and feeding of claim 9, further comprising, after unloading the spool from the spooler, breaking the tab away from the spool.

11. The method for welding wire loading and feeding of claim 9, further comprising, after unloading the spool from the spooler, loading the spool into a wire feeder.

12. The method for welding wire loading and feeding of claim 11, further comprising, after loading the spool into a wire feeder, breaking the tab away from the spool.

13. The method for welding wire loading and feeding of claim 9, wherein the drum comprises a drum perimeter thickness and a drum opening that extends through the drum perimeter thickness.

14. The method for welding wire loading and feeding of claim 13, wherein the drum opening is located along a radial axis that bisects the flange opening.

15. The method for welding wire loading and feeding of claim 9, wherein the flange opening is located along a radial axis that bisects the tab opening.

16. The method for welding wire loading and feeding of claim 9, wherein the attachment area comprises a relief line.

17. The method for welding wire loading and feeding of claim 16, wherein the attachment area comprises perforations.

* * * * *